US005575925A

United States Patent [19]

Logue, Jr.

[11] Patent Number: 5,575,925

[45] Date of Patent: *Nov. 19, 1996

[54] STORM SEWER CATCH BASIN AND FILTER

[76] Inventor: George E. Logue, Jr., HC 64, Box 298A, Trout Run, Pa. 17771

[ * ] Notice: The term of this patent shall not extend beyond the expiration date of Pat. No. 5,372,714.

[21] Appl. No.: 353,786

[22] Filed: Dec. 12, 1994

Related U.S. Application Data

[63] Continuation of Ser. No. 139,098, Oct. 21, 1993, Pat. No. 5,372,714.

[51] Int. Cl.[6] ..... E03F 5/14

[52] U.S. Cl. ..... 210/747; 210/164; 210/232; 210/237; 210/445; 210/474; 404/4; 404/5

[58] Field of Search ..... 210/162, 163, 210/164, 165, 232, 445, 473, 474, 237, 484, 485, 747; 404/2, 3, 4, 5

[56] References Cited

U.S. PATENT DOCUMENTS

| | | | |
|---|---|---|---|
| 806,920 | 12/1905 | Rossi . | |
| 809,201 | 1/1906 | Lutz . | |
| 970,398 | 9/1910 | Sapp | 210/485 |
| 1,111,249 | 9/1914 | Courtwright | 210/485 |
| 1,310,055 | 7/1919 | Caldwell . | |
| 1,654,247 | 12/1927 | Egan . | |
| 1,746,121 | 2/1930 | Levy . | |
| 2,102,310 | 12/1937 | Egan . | |
| 2,246,012 | 6/1941 | Sanders . | |
| 2,263,259 | 11/1941 | Boosey . | |
| 2,496,757 | 2/1950 | Sieling | 210/485 |
| 2,615,626 | 10/1952 | Lane . | |
| 3,282,430 | 11/1966 | Kinne | 210/162 |
| 3,713,539 | 1/1973 | Thompson et al. | 210/164 |
| 4,388,191 | 6/1983 | Morgan | 210/452 |
| 4,419,232 | 12/1983 | Arntyr et al. | 210/164 |
| 5,032,264 | 7/1991 | Geiger | 210/163 |
| 5,066,165 | 11/1991 | Wofford et al. | 405/119 |
| 5,133,619 | 7/1992 | Murfae et al. | 404/4 |
| 5,197,236 | 3/1993 | Calhoun et al. | 52/4 |
| 5,372,714 | 12/1994 | Logue, Jr. | 210/164 |

OTHER PUBLICATIONS

Atlantic Construction Fabrics, Inc. (ACF) Brochure entitled "Complete Source for Geosynthetics", 12 pages.

*Primary Examiner*—Robert J. Popovics
*Attorney, Agent, or Firm*—Webb Ziesenheim Bruening Logsdon Orkin & Hanson P.C.

[57] ABSTRACT

The invention relates to a removable filter for buried catch basins. The filter includes a bag located below grade level in the catch basin and looped flaps which extend above grade level and aid in removal of the filter from the catch basin. The filter is held in place in the basin by a heavy grate which rests on the flaps. The flaps extend at grade level away from the grate. The filter is removed from the catch basin for dumping by inserting a lift rod in each flap loop and hooking lift chains to the rods at openings in the loops.

15 Claims, 1 Drawing Sheet

STORM SEWER CATCH BASIN AND FILTER

CROSS REFERENCE TO RELATED APPLICATION

This application is a continuation of application Ser. No. 08/139,098 filed Oct. 21, 1993, now U.S. Pat. No. 5,372,714.

FIELD OF THE INVENTION

The invention relates to filters for storm sewer catch basins.

DESCRIPTION OF THE PRIOR ART

Ground water from heavy rains or melted snow is collected in a storm sewer catch basin and flows into an underground sewer line. The water flows into the basin through openings in a grate on the top of the basin.

Water entering a sewer line should be free of solids. Conventional storm sewer filters remove solids from the water before the water flows into the catch basin. These filters are made of a porous material and are located at or above grade level. The filters may be placed horizontally on the top of the grate or may be stood up vertically in a circle above grade level, surrounding the grate. Water flows freely through the filter and into the catch basin. Solids are captured by the filter. Over time, the solids build up on the filter, impede the free flow of water through the filter and the collected water floods the area surrounding the storm sewer. Conventional ground storm sewer filters located at or above grade level are readily visible.

For the foregoing reasons there is need for a below grade catch basin filter which filters solids from water without impeding the flow of water through the catch basin and into the sewer and which is easily removed from the catch basin for dumping when filled.

SUMMARY OF THE INVENTION

The invention is a storm sewer catch basin and a removable storm sewer filter. The filter is held in a storm sewer catch basin below grade level between the top of the basin and a grate. The filter includes a bag formed from a porous geotextile material having inwardly tapered sidewalls and flaps at the top of the bag. The grate rests on the flaps to hold the bag in place in the basin. The ends of the flaps are looped and extend at grade level away from the grate. Openings are spaced along the length of the edges of the looped flaps.

Water and solids flow through the openings in the grate and into the catch basin. The water flows into and through the filter bag and out the catch basin. Solids are captured in the bag. The solids accumulate in the bag below grade level and out of sight without impeding the flow of water through the catch basin. When it is necessary to remove the full bag from the catch basin, rods are inserted into the looped flaps, the grate is removed and hooks are secured to the exposed rods at the openings to permit lifting of the heavy, filled filter. The filter is dumped and replaced in the basin, the rods are removed and the grate is refitted in the top of the basin to hold the filter in place.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 1:
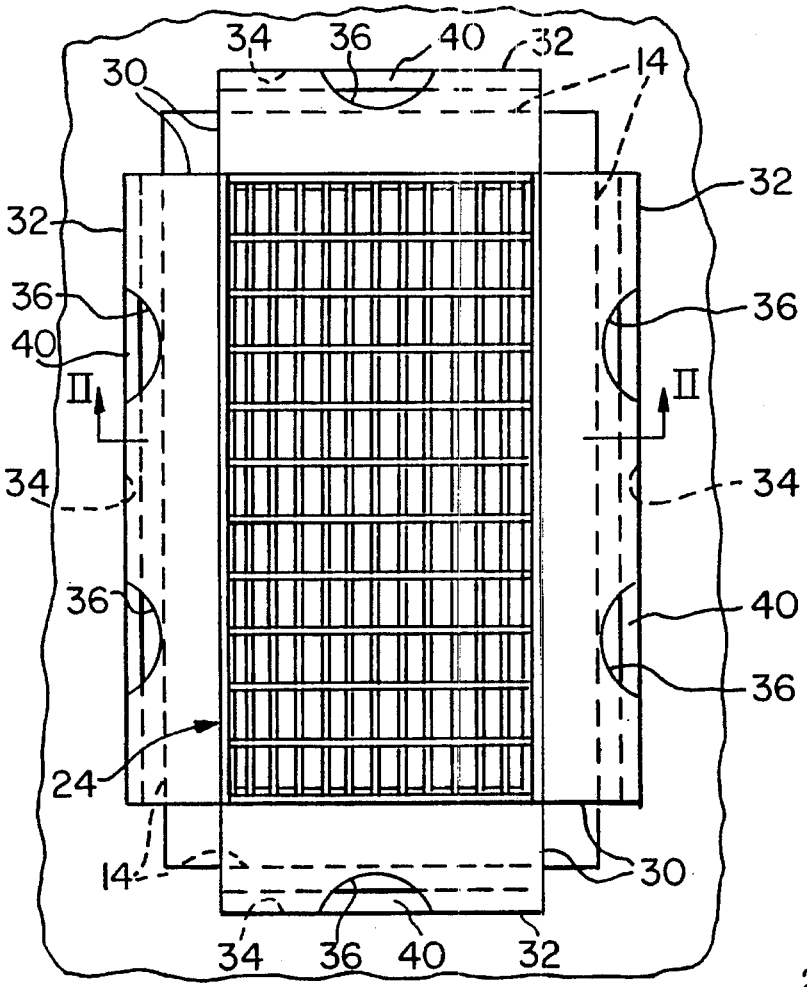
FIG. 1 is a top view of a filter bag in a catch basin below a grate with filter bag flaps extending away from each side of the basin.

Concrete catch basin 12 has an open upper end located at grade level, in-ground sidewalls 14 and floor 16. Concrete storm sewer pipe 18 extends away from one of the sidewalls 14 a distance above floor 16. The sidewalls and floor define chamber 20. A recess or groove 22 extends around the inner edge of the top of the catch basin facing chamber 20. Rectangular grate 24 closes the top of basin 12. The sides of the grate fit in recess 22 in the top of the basin. Ground water flows through the grate and into catch basin chamber 20.

Catch basin filter 26 includes a filter bag 28 in basin chamber 20 and four flaps 30 joining the top of the bag. The flaps extend along the sides of the top of the basin 12 and are sandwiched in recess 22 between the basin and the grate. Flap ends 32 are located outside the sides of the grate. Loops 34 are sewn into the ends of the flaps and extend along the sides of the basin outside the grate. Openings 36 are cut in the ends of the flaps through the loops. As shown in FIG. 1, two openings 36 are provided in each long flap and one opening is provided in each short flap. Lift rods 40 are inserted in the loops 34 and are exposed at openings 36. When it is necessary to lift the bag from the basin, a lift rod is inserted in each flap loop between the open ends of the flap. Lift chains are hooked to the exposed rods at the openings to lift the full filter from the basin.

Filter bag 28 includes four tapered sidewalls 38 each located adjacent one wall of basin 12. The sidewalls are sewn together to form the closed filter bag. Flaps 30 are extensions of the bag sidewalls.

Filter 26 is preferably made from a woven plastic fabric. Narrow strips of a plastic, such as polypropylene, are tightly woven together to form a porous fabric. The fabric permits liquids to flow freely through the filter bag but captures solids. A filter made from plastic fabric, commonly referred to as geotextile, can support a load of solids having a total weight of up to 4,000 pounds.

Figure 2:
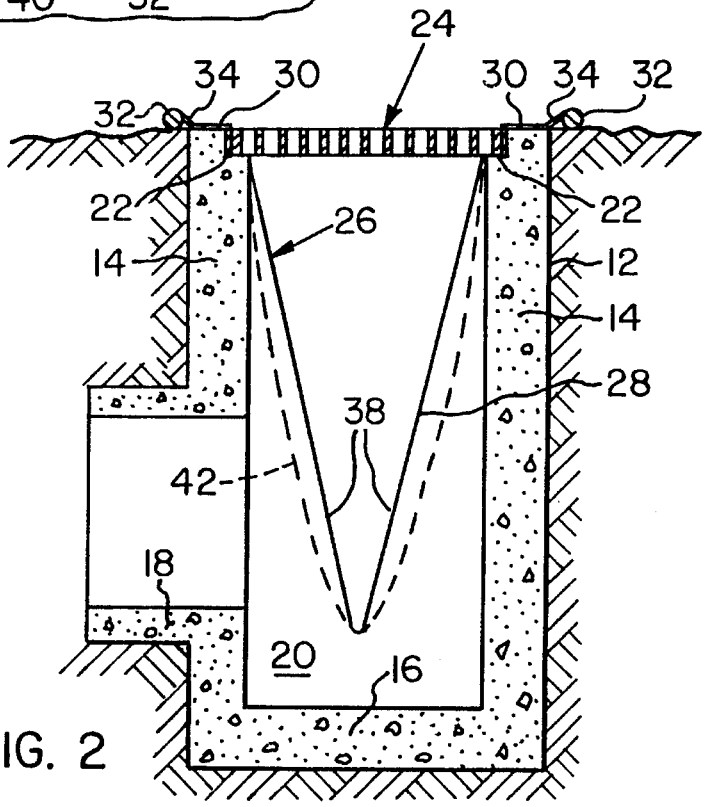
FIG. 2 is a sectional view taken along line 2—2 of FIG. 1.

Bag 28 of filter 26 is located in chamber 20 with flaps 30 extending at grade level away from the catch basin. The tapered bag sidewalls 38 are located away from the walls of chamber 20 and outlet 18 as the bag hangs in the catch basin. As shown in FIG. 1, the upper or top portion of each bag sidewall extends along each basin sidewall. The width of the bag sidewalls decreases below the grate so that the bag hangs free of the sidewalls of the catch basin and does not obstruct filtration even when filled with solids and outwardly bowed as shown by dashed line 42. Grate 42 is fitted in the recess sandwiching the flaps between the grate and the basin. See FIG. 2. The weight of the grate maintains the bag in the chamber.

Ground water and solids flow through the grate and into the filter bag 28 in the catch basin 12. The ground water flows through the bag sidewalls and out of the catch basin through outlet pipe 18. Solids are filtered from the ground water and captured in the bag. Over time, solids accumulate in the bag. The weight of the accumulated solids causes the bag to expand. As the bag expands and becomes full, the walls of the bag do not come in contact with the sidewalls of the catch basin chamber. Thus, the expanded bag does not block the flow of water through the catch basin chamber or into the pipe 18 and can be easily removed from the chamber.

When the bag is full, lift rods 40 are inserted in the flaps 36. The grate 24 is removed, hooks are secured to the length of rod exposed in arcuate openings 36 and the bag is lifted from the catch basin. The bag is dumped and replaced in the catch basin. The grate is refitted in recess 22 to hold the empty filter in place and the rods are removed from the flaps.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A catch basin filter for use with a catch basin and a grate, wherein the catch basin filter includes:

a) a filter bag adapted to be received in the catch basin for capturing the solids which enter the catch basin through an inlet of the catch basin, said bag having an open top adapted to be positioned at the catch basin inlet, a closed bottom and bag sidewalls;

b) a plurality of elongated lift flaps each having a first end and a second end joining the top of the bag and adapted to extend across sidewalls of the catch basin at the catch basin inlet, loops defined in the flaps away from the bag and spaced openings intermediate either end of each flap in the loops, each of said loops adapted to receive a lift rod; and c) a plurality of lift rods of sufficient length extended into the loops in the flaps so that portions of the rods are exposed at the openings for attachment to lift members, whereby portions of the flaps between the filter bag and the loops are adapted to extend between the grate and the catch basin inlet so that the grate sandwiches the flaps in place against the catch basin and the flaps support the bag in the catch basin.

2. The catch basin filter of claim 1, wherein the catch basin is rectangular and the filter bag includes two pairs of opposed flaps.

3. The catch basin filter of claim 1, wherein the bag and flaps are formed from plastic fabric.

4. The catch basin filter as in claim 1, wherein the bag has a pair of narrow sidewalls and a pair of wide sidewalls and a pair of narrow flaps and a pair of wide flaps.

5. The catch basin filter as in claim 2, including a single opening in each narrow flap and a pair of openings in each wide flap.

6. The catch basin filter as in claim 1, wherein a recess is defined at the top of the catch basin, the recess adapted to support the grate.

7. The catch basin filter as in claim 1, wherein a recess is defined in the top of the catch basin, and the grate being adapted to seat in the recess for securing the flaps against the recess.

8. The catch basin filter as in claim 1, wherein the filter bag is formed of a woven material.

9. The catch basin filter of claim 8, wherein the woven material is plastic.

10. A method of installing a catch basin filter in a catch basin, the catch basin comprising:

an inlet through which water and solids flow into the catch basin, an outlet through which water flows out of the catch basin, wherein the inlet is positioned above the outlet, and a plurality of basin sidewalls, each sidewall having an upper end at the inlet and a recess located at the upper end, the sidewalls defining a chamber, the grate located on the top of the basin inlet and having grate sides positioned in the recesses, and the filter comprising:

a filter bag having an open top, a closed bottom and one or more sidewalls extending between the top and the bottom of the bag; and a flap joining the top of each sidewall, said method comprising the steps of:

placing the filter bag in the catch basin so that each of the bag sidewalls are adjacent to the catch basin sidewalls and the filter bag open top is positioned above the filter bag closed bottom;

placing each of the filter bag flaps into the recess of the upper end of the catch basin; and sandwiching each of the filter bag flaps between the top of the basin and the grate sides, thereby holding the bag in place.

11. The method as claimed in claim 10 further comprising the steps of:

removing the grate after the filter bag has accumulated with solids;

removing the filter bag from the catch basin; and dumping of the filter bag.

12. The method as claimed in claim 11, wherein said filter bag further comprises a removal member secured to one of said filter bag sidewalls, the method further comprising removing the filter bag from the catch basin by using a lift member coacting with the removal member.

13. A catch basin filter for use with a catch basin and a grate, wherein the catch basin filter includes:

a) a filter bag adapted to be received in the catch basin filter for capturing the solids which enter the catch basin through an inlet of the catch basin, said bag having a rectangularly shaped open top adapted to be positioned at the catch basin inlet, a closed bottom and four tapered bag sidewalls, wherein upper ends of the sidewalls define the rectangularly shaped open end; and b) four elongated lift flaps each having a first end a second end joining the top of the filter bag, wherein each of the flaps is joined to an upper end of a respective one of the bag sidewalls, the lift flaps are adapted to extend across sidewalls of the catch basin at the catch basin inlet, loops defined in a plurality of the flaps positioned away from the bag and spaced openings intermediate either end of each flap defined in the loops, whereby portions of the flaps between the filter bag and the loops are adapted to extend between the grate and the catch basin inlet so that the grate sandwiches the flaps in place against the catch basin and the flaps support the bag in the catch basin.

14. The catch basin filter of claim 13, wherein the filter bag is formed of a woven material.

15. The catch basin filter as in claim 13, wherein the bag has a pair of narrow sidewalls and a pair of wide sidewalls and a pair of narrow flaps and a pair of wide flaps.

* * * * *

US005575925C1

(12) REEXAMINATION CERTIFICATE (4284th)

United States Patent

Logue, Jr.

(10) Number: US 5,575,925 C1

(45) Certificate Issued: Mar. 6, 2001

(54) STORM SEWER CATCH BASIN AND FILTER

(75) Inventor: George E. Logue, Jr., HC 64, Box 298A, Trout Run, PA (US) 17771

(73) Assignee: George E. Logue, Jr., Trout Run, PA (US)

Reexamination Requests:
No. 90/005,603, Dec. 30, 1999
No. 90/005,652, Feb. 29, 2000

Reexamination Certificate for:

| | |
|---|---|
| Patent No.: | **5,575,925** |
| Issued: | **Nov. 19, 1996** |
| Appl. No.: | **08/353,786** |
| Filed: | **Dec. 12, 1994** |

( * ) Notice: This patent is subject to a terminal disclaimer.

Related U.S. Application Data

(63) Continuation of application No. 08/139,098, filed on Oct. 21, 1993, now Pat. No. 5,372,714.

(51) Int. Cl.[7] ..... E03F 5/14

(52) U.S. Cl. ..... 210/747; 210/164; 210/232; 210/237; 210/445; 210/474; 404/4; 404/5

(58) Field of Search ..... 210/747, 164, 210/232, 237, 445, 474; 404/4, 5

(56) References Cited

U.S. PATENT DOCUMENTS

| | | | | |
|---|---|---|---|---|
| 2,496,757 | | 2/1950 | Sieling . | |
| 3,282,430 | | 11/1966 | Kinne . | |
| 4,419,232 | | 12/1983 | Arntyr et al. . | |
| 5,223,154 | * | 6/1993 | MacPherson, Jr. et al. | 210/163 |
| 5,297,367 | * | 3/1994 | Sainz | 210/307 |
| 5,723,445 | * | 3/1998 | Fanelli | 210/164 |
| 5,954,952 | * | 9/1999 | Strawset, Sr. | 210/164 |
| 6,010,622 | * | 1/2000 | Chinn et al. | 210/164 |
| 6,045,691 | * | 4/2000 | McDesmott | 210/164 |
| 6,059,964 | * | 5/2000 | Strawser, Sr. | 210/164 |
| 6,086,758 | * | 7/2000 | Schilling et al. | 210/164 |
| 6,093,314 | * | 7/2000 | Wilson et al. | 210/164 |

OTHER PUBLICATIONS

Metal Era FLyer, "Metal Era Inlet Basket", 1990.

"Wisconsin Construction Site Best Management Practice Handbook", Wisconsin Department of Natural Resources, 1990.

Meta Era Flyer, "Metal Era Inlet Basket—New Pricing", 1990.

"Soil Erosion Control Plan", City of Milwaukee Department of Public Works, 1988.

* cited by examiner

*Primary Examiner*—Robert Popovics

(57) ABSTRACT

The invention relates to a removable filter for buried catch basins. The filter includes a bag located below grade level in the catch basin and looped flaps which extend above grade level and aid in removal of the filter from the catch basin. The filter is held in place in the basin by a heavy grate which rests on the flaps. The flaps extend at grade level away from the grate. The filter is removed from the catch basin for dumping by inserting a lift rod in each flap loop and hooking lift chains to the rods at openings in the loops.

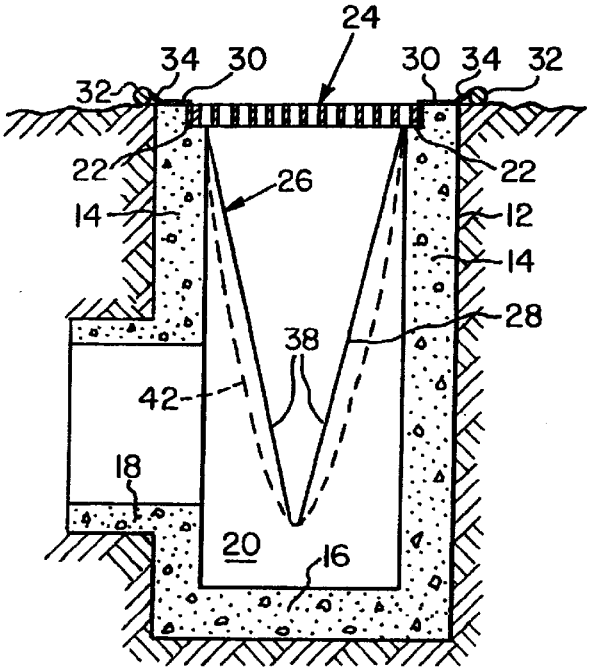

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 48–60:

Bag 28 of filter 26 is located in chamber 20 with flaps 30 extending at grade level away from the catch basin. The tapered bag sidewalls 38 are located away from the walls of chamber 20 and outlet 18 as the bag hangs in the catch basin. As shown in FIG. 1, the upper or top portion of each bag sidewall extends along each basin sidewall. The width of the bag sidewalls decreases below the grate so that the bag hangs free of the sidewalls of the catch basin and does not obstruct filtration even when filled with solids and outwardly bowed as shown by dashed line 42. Grate [42] *24* is fitted in the recess sandwiching the flaps between the grate and the basin. See FIG. 2. The weight of the grate maintains the bag in the chamber.

AS A RESULT OF REEXAMINATION, IT HAS BEEN DETERMINED THAT:

The patentability of claims 1–15 is confirmed.

* * * * *

US005575925C2

(12) EX PARTE REEXAMINATION CERTIFICATE (6406th)

United States Patent
Logue, Jr.

(10) Number: US 5,575,925 C2
(45) **Certificate Issued: *Aug. 26, 2008**

(54) STORM SEWER CATCH BASIN AND FILTER

(76) Inventor: George E. Logue, Jr., HC 64, Box 298A, Trout Run, PA (US) 17771

Reexamination Request:
No. 90/007,475, Mar. 23, 2005
No. 90/008,060, May 17, 2006

Reexamination Certificate for:

| | |
|---|---|
| Patent No.: | **5,575,925** |
| Issued: | **Nov. 19, 1996** |
| Appl. No.: | **08/353,786** |
| Filed: | **Dec. 12, 1994** |

Reexamination Certificate C1 5,575,925 issued Mar. 6, 2001

( * ) Notice: This patent is subject to a terminal disclaimer.

Related U.S. Application Data

(63) Continuation of application No. 08/139,098, filed on Oct. 21, 1993, now Pat. No. 5,372,714.

(51) Int. Cl.
*E03F 5/14* (2006.01)

(52) U.S. Cl. ..... 210/747; 210/164; 210/232; 210/237; 210/445; 210/474; 404/4; 404/5

(58) Field of Classification Search ..... None

See application file for complete search history.

(56) References Cited

PUBLICATIONS

City of Redmond, WA, construction site plan, "Heritage Greens Apartments," Jan. 17, 1991.
City of Redmond, WA, construction site plan, "Zetron Building C," Nov. 26, 1991.
City of Redmond, WA, construction site plan, "Youell—Osborne II Short Plat," Dec. 31, 1992.
City of Redmond, WA, construction site plan, "Site Improv. Plan TESC Plan Redmond Christian School," Jul. 1, 1989.
City of Redmond, WA, construction site plan, "Abbey Road—Div. H.," Aug. 14, 1989.
City of Redmond, WA, construction site plan, "Sirich Int'l Building," Dec. 31, 1991.
City of Redmond, WA, construction site plan, "Fir Glen Estates," Oct. 16, 1990.
City of Bellevue, WA, construction site plan, "Temp. Erosion/Sed. Ctrl. Plan, 12336 N.E.24th Street," Sep. 15, 1992.
City of Bellevue, WA, construction site plan, "Covington Park," Jan. 31, 1990.

*Primary Examiner*—Joseph A. Kaufman

(57) ABSTRACT

The invention relates to a removable filter for buried catch basins. The filter includes a bag located below grade level in the catch basin and looped flaps which extend above grade level and aid in removal of the filter from the catch basin. The filter is held in place in the basin by a heavy grate which rests on the flaps. The flaps extend at grade level away from the grate. The filter is removed from the catch basin for dumping by inserting a lift rod in each flap loop and hooking lift chains to the rods at openings in the loops.

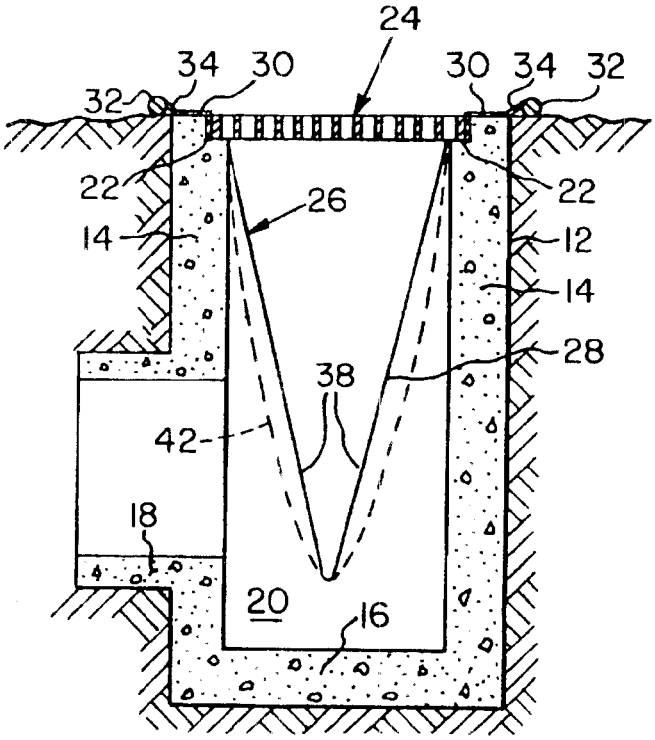

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–9 and 13–15 is confirmed.

Claim 10 is determined to be patentable as amended.

Claims 11 and 12, dependent on an amended claim, are determined to be patentable.

10. A method of installing a catch basin filter in a catch basin, the catch basin comprising:

an inlet through which water and solids flow into the catch basin, an outlet through which water flows out of the catch basin, wherein the inlet is positioned above the outlet, and a plurality of basin sidewalls, each sidewall having an upper end at the inlet and a recess located at the upper end, the sidewalls defining a chamber, the grate located on the top of the basin inlet and having grate sides positioned in the recesses, and the filter comprising:

a filter bag having an open top, a closed bottom and one or more sidewalls extending between the top and the bottom of the bag; and a flap joining the top of each sidewall, said method comprising the steps of:

*preforming the filter bag by joining sidewall portions together;* placing the filter bag in the catch basin so that each of the bag sidewalls are adjacent to the catch basin sidewalls and the filter bag open top is positioned above the filter bag closed bottom;

placing each of the filter bag flaps into the recess of the upper end of the catch basin; and sandwiching each of the filter bag flaps between the top of the basin and the grate sides, thereby holding the bag in place.

* * * * *